United States Patent [19]

Tesch

[11] Patent Number: 5,023,970

[45] Date of Patent: Jun. 18, 1991

[54] BED COVER

[76] Inventor: Günter Tesch, Avenue Jean-Marie-Musy 15, Fribourg, Switzerland, CH-1700

[21] Appl. No.: 322,994

[22] Filed: Mar. 14, 1989

[30] Foreign Application Priority Data

Mar. 28, 1988 [CH] Switzerland ..... 01130/88

[51] Int. Cl.[5] ..... A47G 9/00

[52] U.S. Cl. ..... 5/502; 5/482

[58] Field of Search ..... 5/502, 500, 482, 421, 5/483, 459; 428/155

[56] References Cited

U.S. PATENT DOCUMENTS

| | | | |
|---|---|---|---|
| 2,726,977 | 12/1955 | See | 5/483 |
| 3,199,123 | 8/1965 | Komiske | 5/502 |
| 3,585,645 | 6/1971 | Moriwaki | 2/272 |
| 3,818,521 | 6/1974 | Richards | 5/459 |
| 4,549,323 | 10/1985 | Brockhaus | 5/502 |
| 4,637,947 | 1/1987 | Maekawa | 5/483 |
| 4,765,323 | 8/1988 | Poettgen | 5/502 |

FOREIGN PATENT DOCUMENTS

| | | | |
|---|---|---|---|
| 875785 | 7/1949 | Fed. Rep. of Germany | 2/97 |
| 942165 | 4/1956 | Fed. Rep. of Germany | 5/502 |
| 7715468 | 5/1977 | Fed. Rep. of Germany . | |
| 242090 | 9/1946 | Switzerland | 5/502 |
| 706252 | 3/1954 | United Kingdom | 5/502 |

*Primary Examiner*—Gary L. Smith
*Assistant Examiner*—F. Saether
*Attorney, Agent, or Firm*—Bacon & Thomas

[57] ABSTRACT

A cover, in particular a bed cover, which comprises a case having two outer sheets, a filling and a thin sheet or foil located between the outer sheets is described, characterized in that the thin sheet is provided with a plurality of slits. Advantageously, the thin sheet comprises a plastic material, preferably having a vapor deposited aluminum coating. This results in a cover whereby the transport of heat through the cover is appreciably reduced.

17 Claims, 1 Drawing Sheet

FIG. 1
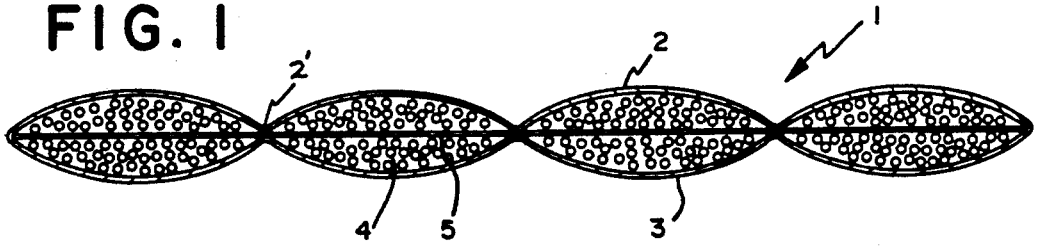
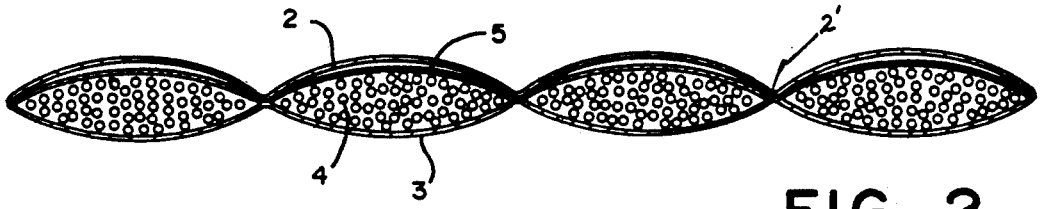
FIG. 2
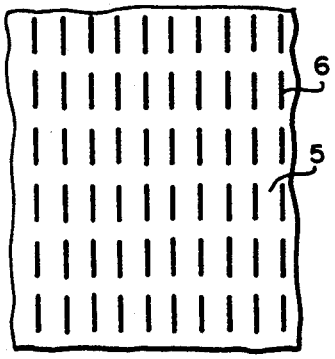
FIG. 3
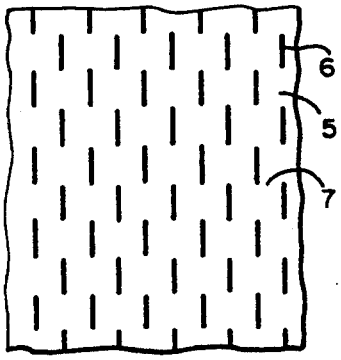
FIG. 4
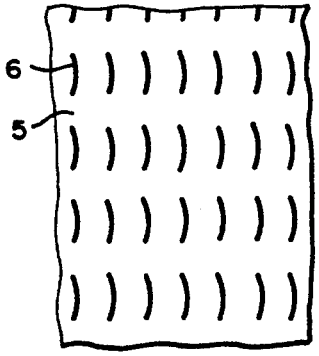
FIG. 5
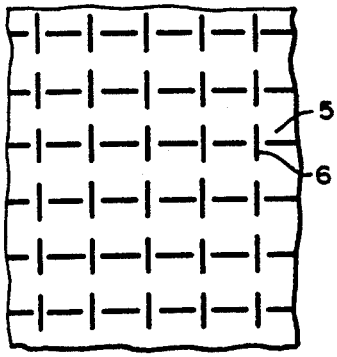
FIG. 6
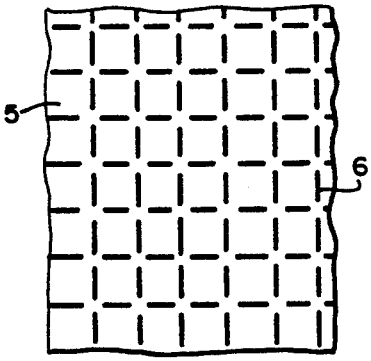
FIG. 7
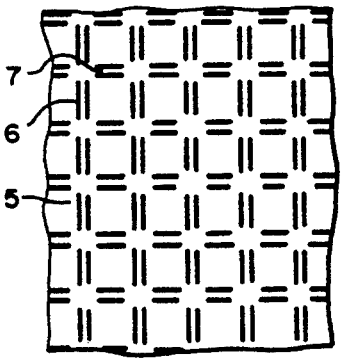
FIG. 8

BED COVER

The invention concerns a cover, in particular, a bed cover. German publication DE-U-7,715,468 discloses a cover, in particular, a bed cover comprising a case having two external sheets, a filling and an intermediate sheet located between the two external sheets. In this cover, the intermediate sheet is located centrally between the two external sheets to define two separate filling spaces, which may be filled differently. One half of the cover may thus be filled with natural down or feathers, while the other half maybe filled with an unstabilized fiber fleece, synthetic down, or the like.

The intermediate sheet of DE-U-7,715,468 merely serves to separate the two different halves of the filling from each other. Because of the down used, the intermediate sheet, which is usually constructed of a woven fabric, must be "down tight," so that the down cannot migrate through the intermediate sheet.

In this known cover, the two external sheets are joined together through the intermediate sheet by means of quilting.

An object of a copending application is to provide a cover, in particular, a bed cover, in which spherical fiber aggregates of spherically tangled fibers are used as the filling. Such a cover is easily produced using these fiber aggregates.

A bed cover is intended essentially to create a stationary air cushion between a person using the cover and the environment. If much air is present between the filling components, the cover acts as a thermal insulator by virtue of the stationary air within the filling.

In the case of quilted covers, such as the cover disclosed in DE-U-7,715,468, wherein, at the quilting seams, one external sheet rests directly on the other with only an intermediate sheet between the external sheets, a so-called "cold bridge" exists. The cold bridge represents a zone of higher thermal loss which exists at the quilted seams.

It is desirable, particularly in the case of bed covers, for the cover to permit passage of human effluvia and humidity caused by human perspiration outwardly through the cover.

It is an object of the invention to provide a cover of the aforementioned generic type, whereby the transport of heat through said cover is appreciably reduced. The cover of the present invention comprises a case having two outer sheets, a filling and an intermediate sheet located between the outer sheets, wherein the intermediate sheet is a thin sheet (i.e., thin foil) provided with slits.

These objects are attained by the cover according to the present invention. The invention is based on the concept that the less humidity, gases or the like which are permitted to pass freely inwardly and outwardly through the cover, the more thermally tight the cover will be.

In the cover according to the invention, the intermediate sheet is preferably a thin sheet (foil) having longitudinal slits. This sheet reduces the possibility of the rapid exchange of air inwardly and outwardly through the cover, while still permitting adequate outward passage of humidity and gases.

Such a thin sheet may, for example, be a plastic sheet, as plastic sheets are inherently gas tight. A reduced exchange of air and humidity may still take place by means of the slits.

According to a further embodiment, the intermediate sheet may be a metal foil, which has the advantage that it reflects the heat impacting it. However, metal foils are highly sensitive to mechanical stress and may be gradually destroyed by extended use.

Preferably, therefore, a sheet of coated plastic may be used, in particular, a plastic sheet with a vapor deposited aluminum coating. This combines the advantages of a plastic sheet with those of a metal foil.

Loss of heat through the cover of the invention is particularly reduced in the area of the quilted seams, as the intermediate sheet in the cover both prevents thermal convection and reflects the heat. If the intermediate sheet has no slits in the area of the quilted seams, the loss of heat will be reduced even further.

Further details and advantages of the invention will become apparent from the appended claims and from the description of the invention with reference to the drawing.

BRIEF DESCRIPTION OF THE DRAWING

FIG. 1 is a sectional view of a cover according to a first embodiment wherein a thin sheet is located centrally between two outer sheets of the cover and the filling.

FIG. 2 is a sectional view of a cover according to a second embodiment wherein a thin sheet is located adjacent one of the two outer sheets.

FIG. 3 is a top view of a segment of a thin sheet with longitudinal slits according to the first embodiment of the thin sheet.

FIG. 4 is a top view of a segment of a thin sheet with longitudinal slits according to the second embodiment of the thin sheet.

FIG. 5 is a top view of a segment of a thin sheet with arc-shaped slits according to a third embodiment of thin sheet.

FIG. 6 is a top view of a segment of a thin sheet with longitudinal slits according to a fourth embodiment of the thin sheet.

FIG. 7 is a top view of a segment of a thin sheet with longitudinal slits according to a fifth embodiment of the thin sheet.

FIG. 8 is a top view of a segment of a thin sheet with longitudinal slits according to a sixth embodiment of the thin sheet.

DETAILED DESCRIPTION

FIGS. 1 and 2 both show schematically a section through a quilted cover 1. The cover 1 comprises two outer sheets 2 and 3, a filling 4 located between said outer sheets, and a thin sheet or foil 5 placed between said outer sheets. The thin sheet 5 is hereinafter described in detail.

The cover shown in FIGS. 1 and 2 is quilted at 2'. However, the cover may be non-quilted (without quilting).

The filling 4 comprises spherical fiber aggregates of spherically tangled fibers, which may have diameters of, for example, 3 to 15 mm. The filling 4 may alternatively comprise conventional filler materials, such as down, feathers, fiber fleece, or the like. A mixture of different filler materials may also be used.

In FIGS. 1 and 2, the individual fiber aggregates comprising the filling 4 are shown enlarged. However, many more fiber aggregates may be present in the cover 1. Furthermore, the fiber aggregates may be arranged closer in space to one another. Individual fibers of one aggregate may even penetrate into another aggregate.

In FIG. 1, the sheet 5 is located centrally between the two outer sheets 2 and 3 of the cover 1, with approximately the same quantity of filler materials being present on either side of the intermediate sheet 5. The filling 4 may comprised of different filler materials or mixtures of different filler materials, on either side of intermediate sheet 5.

Intermediate sheet 5 is in contact with the two outer sheets 2 and 3 only in the area of quilting. Otherwise, filling 4, which may be fiber aggregates, is present between the intermediate sheet 5 and the outer sheets 2 and 3.

In the embodiment according to FIG. 1, the cover 1 has a symmetrical configuration. Accordingly, it makes no difference which side of the cover is in contact with the body of the user.

In the embodiment according to FIG. 2, the thin sheet 5 is located adjacent outer sheet 2. Thus, the sheet 5 is in direct contact with said outer sheet 2. Alternatively, (not shown) a thin layer of filling 4 may be present between sheet 5 and outer sheet 2. Thin sheet 5 is in contact with outer sheet 3 only in the area of quilting. Otherwise, fiber aggregates of the filling 4 are shown between sheet 5 and the outer sheet 3.

The cover 1 as shown in FIG. 2 may be used with the sheet 5 at the top or at the bottom of the cover. If the sheet 5 is at the bottom (i.e., closer to the user), more heat, humidity, etc. is stored under cover 1, which may be advantageous if it is very cold, or if the person using the cover desires to perspire (i.e., because of influenza). Sheet 5, particularly when coated with metal, reflects heat very well.

If sheet 5 is located at the top side of cover 1, (i.e., away from the user) humidity and heat may penetrate into the cover. Humidity may escape through slits contained in the thin sheet. Sheet 5, particularly if coated with metal, reflects the heat in the cover toward the person using it.

FIGS. 3 to 8 show different configurations of the thin sheet or foil 5. According to a preferred embodiment, sheet 5 comprises a plastic, which may optionally be coated with, for example, a metal. The preferred metal is aluminum. The coating of the metal onto the plastic may be achieved by well known vapor deposition methods.

Sheet 5 may be provided with slits 6 which may be of any shape, but which are preferably longitudinal or arc shaped. The slits 6 penetrate sheet 5 entirely and are arranged in columns, which may be in the longitudinal direction of the slits 6. Alternatively, some or all of the columns may be transverse or oblique to the longitudinal direction of the slits 6. The slitting of the intermediate sheet 5 results in webs 7 between slits 6.

The slitting of foil is known, in particular with reference to DE-A-1,915,523.

FIG. 3 shows longitudinal slits 6 arranged in parallel columns, the individual slits also being parallel in the longitudinal direction. Adjacent columns of slits are spaced apart at a mutual distance approximately corresponding to the length of a slit. The distance between slits 6 within a column corresponds to about one-half of the length of a slit. Zones without slits are located between columns and rows of slits 6.

Slits 6 in the layout depicted in FIG. 3 remain essentially closed, even if a mechanical tensile stress is applied to the cover and thus to sheet 5. The mechanical stress may be applied along the longitudinal direction of the slits 6, of transversely thereto.

FIG. 4 shows a layout of slits 6 which are also arranged in parallel columns. Each column, however, is staggered in the longitudinal direction with respect to the adjacent columns. Slits 6 of adjacent columns are thus offset with respect to each other. The spacing between the columns may be approximately one-half to one length of a slit. The spacing of slits between one another within a column may likewise be from one-half to one length of a slit. Areas without slits according to this configuration are arranged along lines which occur at an angle of about 30° to the longitudinal direction of the slits 6.

Due to the offset locations of the slits 6 in the configuration of FIG. 4, the slits are able to open in a transverse manner under tensile stress, whereby the webs 7 between the slits 6 are caused to curve outwardly. An increased exchange of air may thus take place through sheet 5 by stretching the sheet 5 transversely to its longitudinal direction. The stretching of the sheet 5 may be effected by stretching the entire cover, or by pulling the cover 1 in one or more locations in order to apply pressure to the thin sheet, this pressure being perpendicular to the longitudinal direction of the slits 6.

FIG. 5 shows arc-shaped slits 6 arranged in parallel columns. The spacing of adjacent slits within a column corresponds to approximately one slit length. The spacing of adjacent columns of slits is slightly larger than a slit length. The arc of each slit corresponds to approximately 1/20 to 1/6 of a circular line. With slits of this configuration, a U-shaped flake formed by each slit extends outwardly from the plane of the thin sheet 5 when stress is applied perpendicularly to the cover 1 and the sheet 5.

FIG. 6 shows a layout of slits in parallel columns, wherein the slits within one column are arranged perpendicularly to the slits in the adjacent column. The slits which are transverse to the longitudinal direction of sheet 5 are arranged such that an imaginary line connecting them would bisect the slits which are longitudinally oriented. FIG. 7 shows a similar layout, except that an imaginary line connecting the transverse slits would bisect the spaces between the slits which are longitudinally oriented.

FIG. 8 shows a configuration similar to that of FIG. 7, except that the slits 6 are arranged in pairs. Each pair of slits 6 comprises a web 7 between them. The webs 7 may be pushed outwardly by the filling 4 if the cover 1 and sheet 5 are stressed.

The slits 6 may have a length between 2 and 10 mm. The shorter the slits, the more heat-tight the cover 1 will be, and the less humidity will be able to penetrate the cover 1. The spacing of adjacent slits within a column may correspond approximately to one-half to one length of a slit. Depending on the shape and configuration of the slits, an optimum spacing may be established which promotes the desired results.

The slits 6 are cut into sheet 5 without removing any material. The slits are therefore closed in the unstressed state of sheet 5. When the cover 1 is in use, i.e., when the cover is filled with filling 4, the filling 4 presses nonuniformly on the areas of sheet 5 where slits 6 are present, so that the slits may be opened to a lesser or greater extent outwardly of the plane of sheet 5.

The permeability of sheet 5 depends on the form and layout of the slits 6, with different shapes and configurations being known to those skilled in the art.

In order to prevent cold bridges from occurring in the quilted areas, or to reduce their effect, the intermediate sheet may not have any slits in the quilting zone (according to a form of embodiment not shown). In this case, there s usually no filling 4 present in the immediate vicinity of the quilting zone. Therefore, penetration of gases and humidity through the cover 1 is prevented in locations, even though the sheet is perforated by sewing during the quilting process. It is preferable to use a thin sheet 5 of a material which is sturdy enough to stand up to the sewing thread, so that penetration of gases occurs only through the thread holes.

The fiber aggregates used in the invention may preferably be spherical fiber aggregates as disclosed and claimed in copending U.S. patent application Ser. No. 089,403, filed Aug. 26, 1987, now U.S. Pat. No. 4,820,574 and U.S. patent application Ser. No. 089,404, filed Aug. 26, 1987, now U.S. Pat. No. 4,814,229.

I claim:

1. A cover, in particular a bed cover, comprising:

a case having two outer sheets;

a filling between said two outer sheets; and a single thin sheet located between said two outer sheets, said single thin sheet being formed from a plastic material and including a plurality of slits arranged in a predetermined patterned distribution over substantially the entire surface thereof, an opening formed by each slit in said thin sheet is such that the openings are closed when the thin sheet is not stressed.

2. A cover according to claim 1, wherein the thin sheet comprises of a coated plastic material.

3. A cover according to claim 2, wherein the plastic material is coated with a metal.

4. A cover according to claim 3 wherein the plastic material is coated with aluminum.

5. A cover according to claim 4 wherein the aluminum is vapor deposited.

6. A cover according to claim 1, wherein the slits are in parallel alignment with one another.

7. A cover according to claim 1, wherein the slits are arranged such that zones without slits occur between adjacent slits as viewed in the longitudinal direction of said slits.

8. A cover according to claim 7, wherein the zones without slits are perpendicular to the longitudinal direction of the slits.

9. A cover according to claim 6, wherein the slits are arranged in parallel columns.

10. A cover according to claim 9, wherein the slits within one column are offset in relation to the slits in the adjacent columns.

11. A cover according to claim 7, wherein the zones without slits extend obliquely relative to the longitudinal direction of the slits at an angle to the longitudinal direction of the slits between 30° and 60°.

12. A cover according to claim 1, wherein the slits are 2 to 10 mm long.

13. A cover according to claim 1, wherein the slits are spaced one-half to one slit length apart from each adjacent slit in the longitudinal direction.

14. A cover according to claim 9, wherein the columns are spaced one-half to one slit length apart from each adjacent column.

15. A cover according to claim 1, wherein the outer sheets are joined together through the thin sheet by quilting certain areas of the sheets.

16. A cover according to claim 15, wherein the thin sheet does not contain any slits in the quilted areas.

17. A cover according to claim 1, wherein the filling is comprised of spherical fiber aggregates.

* * * * *